US010633840B2

(12) United States Patent
Macsay

(10) Patent No.: US 10,633,840 B2
(45) Date of Patent: Apr. 28, 2020

(54) FAUCET WITH HOSE CONNECTION

(71) Applicant: Moen Incorporated, North Olmsted, OH (US)

(72) Inventor: Steven M. Macsay, Strongsville, OH (US)

(73) Assignee: FB Global Plumbing Group LLC, North Olmsted, OH (US)

( * ) Notice: Subject to any disclaimer, the term of this patent is extended or adjusted under 35 U.S.C. 154(b) by 81 days.

(21) Appl. No.: 15/941,270

(22) Filed: Mar. 30, 2018

(65) Prior Publication Data

US 2019/0301146 A1 Oct. 3, 2019

(51) Int. Cl.
*E03C 1/04* (2006.01)

(52) U.S. Cl.
CPC .... *E03C 1/0403* (2013.01); *E03C 2001/0415* (2013.01); *Y10T 137/9464* (2015.04)

(58) Field of Classification Search
CPC ..... E03C 1/0403; E03C 2001/0415; Y10T 137/9464
See application file for complete search history.

(56) References Cited

U.S. PATENT DOCUMENTS 5,662,276 A 9/1997 Ko
6,302,451 B1 10/2001 Olson
6,543,814 B2 * 4/2003 Bartholomew ..... F16L 37/0987 285/319
6,641,060 B2 11/2003 Brattoli et al.
6,659,124 B2 12/2003 Burns et al.
6,749,135 B2 6/2004 Groblebe et al.
6,880,768 B2 4/2005 Lau
7,341,209 B1 3/2008 Ko
7,438,240 B2 10/2008 Rabe
8,181,997 B2 5/2012 Wang
8,646,476 B2 2/2014 Thomas et al.
9,440,246 B2 9/2016 Meehan et al.
2007/0176023 A1 8/2007 Herring et al.
2013/0186479 A1 * 7/2013 Zhu et al. ..... E03C 1/0403 137/15.01
2013/0333109 A1 * 12/2013 Li et al. ..... E03C 1/0402 4/695

* cited by examiner

*Primary Examiner* — Kevin L Lee
(74) *Attorney, Agent, or Firm* — Calfee, Halter & Griswold LLP

(57) ABSTRACT

The present invention provides a faucet with a hose connection that is easier to assemble, install, uninstall, and disassemble. The faucet includes a hose, a valve body, a mounting shank, a first hose retainer, and a second hose retainer. The mounting shank includes a first end and a second end. The first hose retainer includes a base section. The base section includes a first hose opening. The second hose retainer includes a first end section, a second end section, and an intermediate section. The first end section includes a second hose opening. The second end section includes a first hose retainer opening. The intermediate section includes a first hose retainer channel. The hose is fluidically connected to the valve body at or near the first end of the mounting shank. The hose is mechanically connected to the valve body at or near the second end of the valve body.

20 Claims, 9 Drawing Sheets

FAUCET WITH HOSE CONNECTION

FIELD

The present invention relates generally to a faucet with a hose connection, and, more particularly, to a faucet with a hose connection that is easier to assemble, install, uninstall, and disassemble.

BACKGROUND

Faucets with hose connections can be difficult to assemble, install, uninstall, and disassemble. Prior faucets with hose connections cause difficulties during assembly, installation, uninstallation, and disassembly.

SUMMARY

The present invention provides a faucet with a hose connection that is easier to assemble, install, uninstall, and disassemble.

In an exemplary embodiment, the hose connection includes a hose, a valve body, a mounting shank, a first hose retainer, and a second hose retainer. The hose includes a first end and a second end. The first end of the hose includes a first hose connector. The second end of the hose includes a second hose connector. The valve body includes a first end section and a second end section. The first end section of the valve body includes a first opening. The first opening in the first end section of the valve body is operable to receive a cartridge assembly. The second end section of the valve body includes a second opening. The second opening in the second end section of the valve body is operable to receive the first hose connector. The mounting shank includes a first end, a second end, and an opening extending through the mounting shank from the first end to the second end. The first end of the mounting shank is operable to be secured to the second end section of the valve body. The first hose retainer includes a base section. The base section of the first hose retainer includes a first hose opening. The first hose opening in the base section of the first hose retainer is operable to receive at least a portion of the hose. The second hose retainer includes a first end section, a second end section, and an intermediate section. The first end section of the second hose retainer includes a second hose opening. The second hose opening in the first end section of the second hose retainer is operable to receive at least a portion of the hose. The second end section of the second hose retainer includes a first hose retainer opening. The first hose retainer opening in the second end section of the second hose retainer is operable to receive at least a portion of the first hose retainer. The intermediate section of the second hose retainer includes a first hose retainer channel. The first hose retainer channel in the intermediate section of the second hose retainer is operable to receive at least a portion of the first hose retainer. The first hose connector of the hose is fluidically sealed in the second opening in the second end section of the valve body thereby fluidically connecting the hose to the valve body at or near the first end of the mounting shank. At least a portion of the first hose retainer engages at least a portion of the second hose retainer thereby mechanically connecting the hose to the valve body at or near the second end of the mounting shank.

In an exemplary embodiment, the hose connection includes a supply hose, a spray hose, a spray retainer, and a supply retainer. The supply hose includes a first end and a second end. The first end of the supply hose includes a first supply hose connector. The second end of the supply hose includes a second supply hose connector. The spray hose includes a first end and a second end. The first end of the spray hose includes a first spray hose connector. The second end of the spray hose includes a second spray hose connector. The spray retainer includes a base section and a first leg. The base section of the spray retainer includes a spray hose opening. The spray hose opening in the base section of the spray retainer is operable to receive at least a portion of the spray hose. The first leg of the spray retainer includes a first connected end and a first free end. The supply retainer includes a first end section, a second end section, and an intermediate section. The first end section of the supply retainer includes a first supply hose opening and a first spray hose opening. The first supply hose opening in the first end section of the supply retainer is operable to receive at least a portion of the supply hose. The first spray hose opening in the first end section of the supply retainer is operable to receive at least a portion of the spray hose. The second end section of the supply retainer includes a second supply hose opening and a spray retainer opening. The second supply hose opening in the second end section of the supply retainer is operable to receive at least a portion of the supply hose. The spray retainer opening in the second end section of the supply retainer is operable to receive at least a portion of the spray retainer. The intermediate section of the supply retainer includes a supply hose channel and a spray retainer channel. The supply hose channel in the intermediate section of the supply retainer is operable to receive at least a portion of the supply hose. The spray retainer channel in intermediate section of the supply retainer is operable to receive at least a portion of the spray retainer. Structure on at least one of the base section and the first leg of the spray retainer engages structure on at least one of the second end section and the intermediate section of the supply retainer to mechanically connect the spray retainer to the supply retainer.

In an exemplary embodiment, the hose connection includes a supply hose, a spray hose, a spray retainer, and a supply retainer. The supply hose includes a first end and a second end. The first end of the supply hose includes a first supply hose connector. The second end of the supply hose includes a second supply hose connector. The spray hose includes a first end and a second end. The first end of the spray hose includes a first spray hose connector. The second end of the spray hose includes a second spray hose connector. The spray retainer includes a base section and a first leg. The base section of the spray retainer includes a spray hose opening. The first leg of the spray retainer includes a first connected end and a first free end. The first free end of the first leg of the spray retainer includes a first inner spray retainer tab. The supply retainer includes a first end section, a second end section, and an intermediate section. The first end section of the supply retainer includes a first supply hose opening and a spray hose opening. The first supply hose opening in the first end section of the supply retainer is operable to receive at least a portion of the supply hose. The spray hose opening in the first end section of the supply retainer is operable to receive at least a portion of the spray hose. The second end section of the supply retainer includes a second supply hose opening, a spray retainer opening, and a first supply retainer tab. The second supply hose opening in the second end section of the supply retainer is operable to receive at least a portion of the supply hose. The spray retainer opening in the second end section of the supply retainer is operable to receive at least a portion of the spray retainer. The intermediate section of the supply retainer includes a supply hose channel and a spray retainer channel. The supply hose channel in the intermediate section of the supply retainer is operable to receive at least a portion of the supply hose. The spray retainer channel in the intermediate section of the supply retainer is operable to receive at least a portion of the spray retainer. The first inner spray retainer tab on the first free end of the first leg of the spray retainer engages the first supply retainer tab on the second end section of the supply retainer to mechanically connect the spray retainer to the supply retainer.

BRIEF DESCRIPTION OF THE DRAWINGS

-FIG. 3*a* is a perspective view, FIG. 3*b* is a front elevational view, FIG. 3*c* is a rear elevational view, FIG. 3*d* is a left side elevational view, FIG. 3*e* is a right side elevational view, FIG. 3*f* is a top plan view, and FIG. 3*g* is a bottom plan view;

-FIG. 4*a* is a perspective view, FIG. 4*b* is a front elevational view, FIG. 4*c* is a rear elevational view, FIG. 4*d* is a left side elevational view, FIG. 4*e* is a right side elevational view, FIG. 4*f* is a top plan view, and FIG. 4*g* is a bottom plan view;

-FIG. 5*a* is a perspective view, FIG. 5*b* is a front elevational view, FIG. 5*c* is a rear elevational view, FIG. 5*d* is a left side elevational view, FIG. 5*e* is a right side elevational view, FIG. 5*f* is a top plan view, and FIG. 5*g* is a bottom plan view;

-FIG. 6*a* is a perspective view, FIG. 6*b* is a front elevational view, FIG. 6*c* is a rear elevational view, FIG. 6*d* is a left side elevational view, FIG. 6*e* is a right side elevational view, FIG. 6*f* is a top plan view, and FIG. 6*g* is a bottom plan view; -FIG. 7*a* is a partial cross-sectional view taken in perspective around the side spray hose, FIG. 7*b* is a partial cross-sectional view taken around the side spray hose, FIG. 7*c* is a cross-sectional view taken through the side spray hose, and FIG. 7*d* is a cross-sectional view taken through the side spray hose with a cartridge assembly received in the valve body;

wherein FIGS. 3*a*-3*g*, 4*a*-4*g*, and 5*a*-5*g* are oriented as the component would be if assembled and installed in the faucet of FIG. 1 with the front view of the component taken from a front side of a hub of the faucet; and wherein FIG. 6*a*-6*g* are oriented as the component would be if assembled and installed in the faucet of FIG. 1 with the front view of the component taken from a rear side of the hub of the faucet.

DETAILED DESCRIPTION

Figure 1:
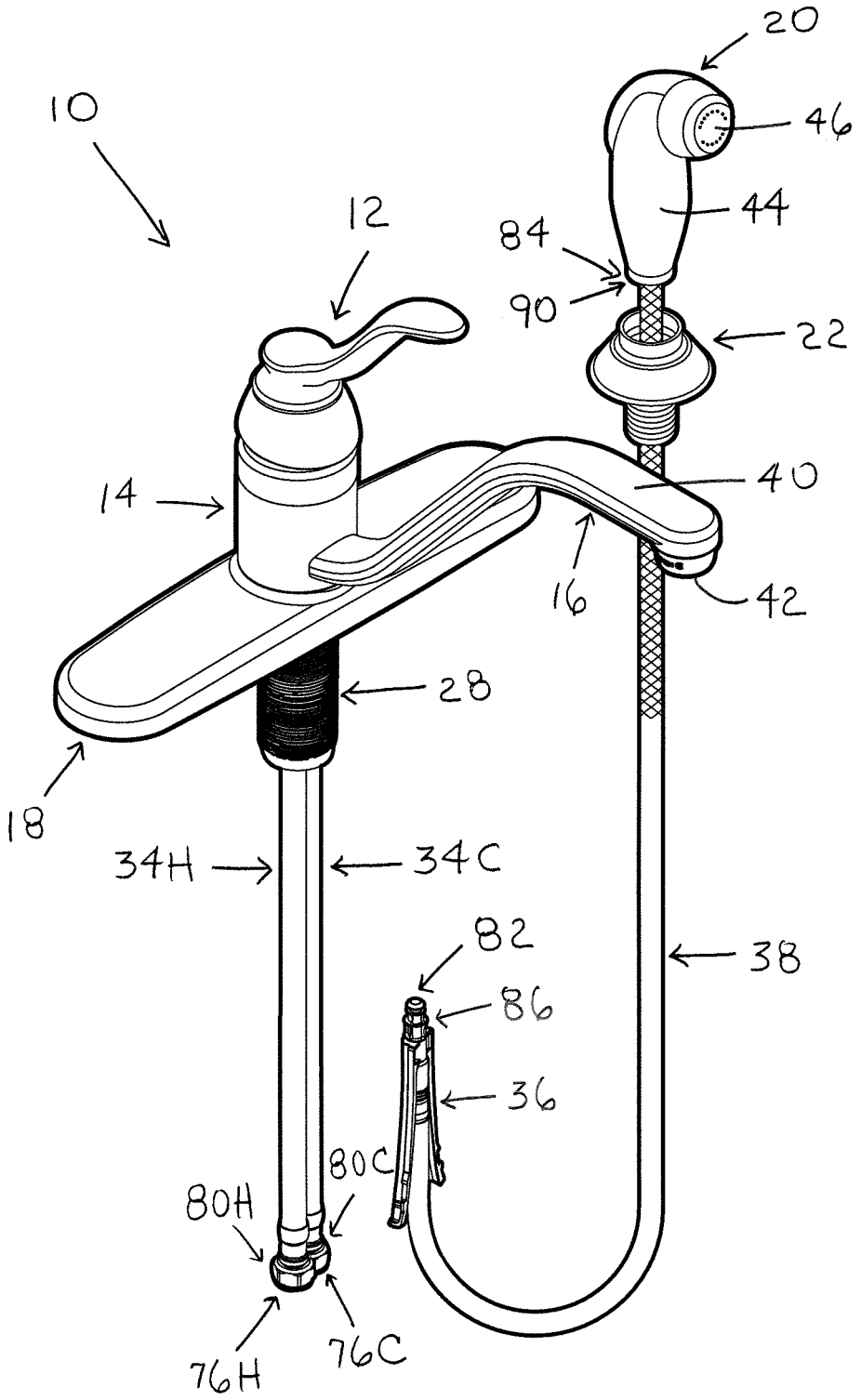
FIG. 1 is a perspective view of a faucet with a side spray hose connection according to an exemplary embodiment of the present invention.

The present invention provides a faucet with a hose connection that is easier to assemble, install, uninstall, and disassemble. In an exemplary embodiment, the hose is a side spray hose for a faucet. In an exemplary embodiment, the hose is a wand hose for a pullout or pulldown faucet. In an exemplary embodiment, the hose is a supply hose for a faucet. For purposes of illustration, a faucet with a side spray hose connection will be shown and described in detail. However, one of ordinary skill in the art will appreciate that the hose connection could be used in a faucet with a wand hose connection and a faucet with a supply hose connection.

An exemplary embodiment of a faucet with a side spray hose connection 10 is shown in FIGS. 1-7*d*. As illustrated, the faucet 10 includes a handle 12, a hub 14, a spout 16, an escutcheon 18, a side spray 20, and a side spray hose guide 22. Additionally, as illustrated, the faucet 10 includes a cartridge assembly 24, a valve body 26, a mounting shank 28, a supply retainer 30, a retaining ring 32, a cold water supply hose 34C, a hot water supply hose 34H, a side spray retainer 36, and a side spray hose 38. Faucets with side sprays are well-known in the art and, therefore, only the relevant components of the faucet with a side spray hose connection 10 will be described in greater detail.

The spout 16 includes a first waterway 40 and a first outlet 42 for delivering water from the faucet 10. The side spray 20 includes a second waterway 44 and a second outlet 46 for delivering water from the faucet 10. The handle 12 is used to control the temperature and flow of water being delivered from the faucet 10 (i.e., the spout 16 or the side spray 20). The cartridge assembly 24 is connected to the handle 12. The cartridge assembly 24 controls the temperature and flow of water being delivered from the faucet 10 based on movement of the handle 12 by the user. In the illustrated embodiment, the cartridge assembly 24 is a ceramic disk cartridge assembly. However, one of ordinary skill in the art will appreciate that other cartridge assemblies could be used in the faucet 10.

An exemplary embodiment of the valve body 26 is shown in FIGS. 3*a*-3*g*. In the illustrated embodiment, the valve body 26 is generally cylindrical shaped. The valve body 26 includes a top or first end section 48, a bottom or second end section 50, and an intermediate section 52. In the illustrated embodiment, the first end section 48 of the valve body 26 includes a first opening 54. In the illustrated embodiment, the first opening 54 in the first end section 48 of the valve body 26 is operable to receive at least a portion of the cartridge assembly 24. In the illustrated embodiment, the second end section 50 of the valve body 26 includes a cold water inlet 56, a hot water inlet 58, and a side spray outlet 60. In the illustrated embodiment, the cold water inlet 56, the hot water inlet 58, and the side spray outlet 60 of the second end section 50 of the valve body 26 are operable to receive a portion of the cold water supply hose 34C, the hot water supply hose 34H, and the side spray hose 38, respectively. The intermediate section 52 of the valve body 26 includes various openings and flow paths for receiving cold and hot water from the cold water supply hose 34C and the hot water supply hose 34H, providing the cold and hot water to the cartridge assembly 24, receiving mixed water from the cartridge assembly 24, and supplying the mixed water to the spout 16 or the side spray 22. In an exemplary embodiment, the valve body 26 is formed from an injection molded thermoplastic or a metal.

An exemplary embodiment of the mounting shank 28 is shown in FIGS. 4*a*-4*g*. In the illustrated embodiment, the mounting shank 28 is generally cylindrical shaped. The mounting shank 28 includes a top or first end 62 and a bottom or second end 64. In the illustrated embodiment, the first end 62 of the mounting shank 28 is operable to be secured to the second end section 50 of the valve body 26. The mounting shank 28 includes an outer surface 66 and an inner surface 68. In the illustrated embodiment, at least a portion of the outer surface 66 of the mounting shank 28 is threaded. In the illustrated embodiment, at least a portion of the inner surface 68 at or near the first end 62 of the mounting shank 28 includes a mounting ledge 70. The mounting shank 28 includes an opening 72 extending through the mounting shank 28 from the first end 62 to the second end 64. In the illustrated embodiment, the opening 72 in the mounting shank 28 is operable to receive at least a portion of the supply retainer 30. In an exemplary embodiment, the mounting shank 28 is formed from an injection molded thermoplastic or a metal.

Figure 2:
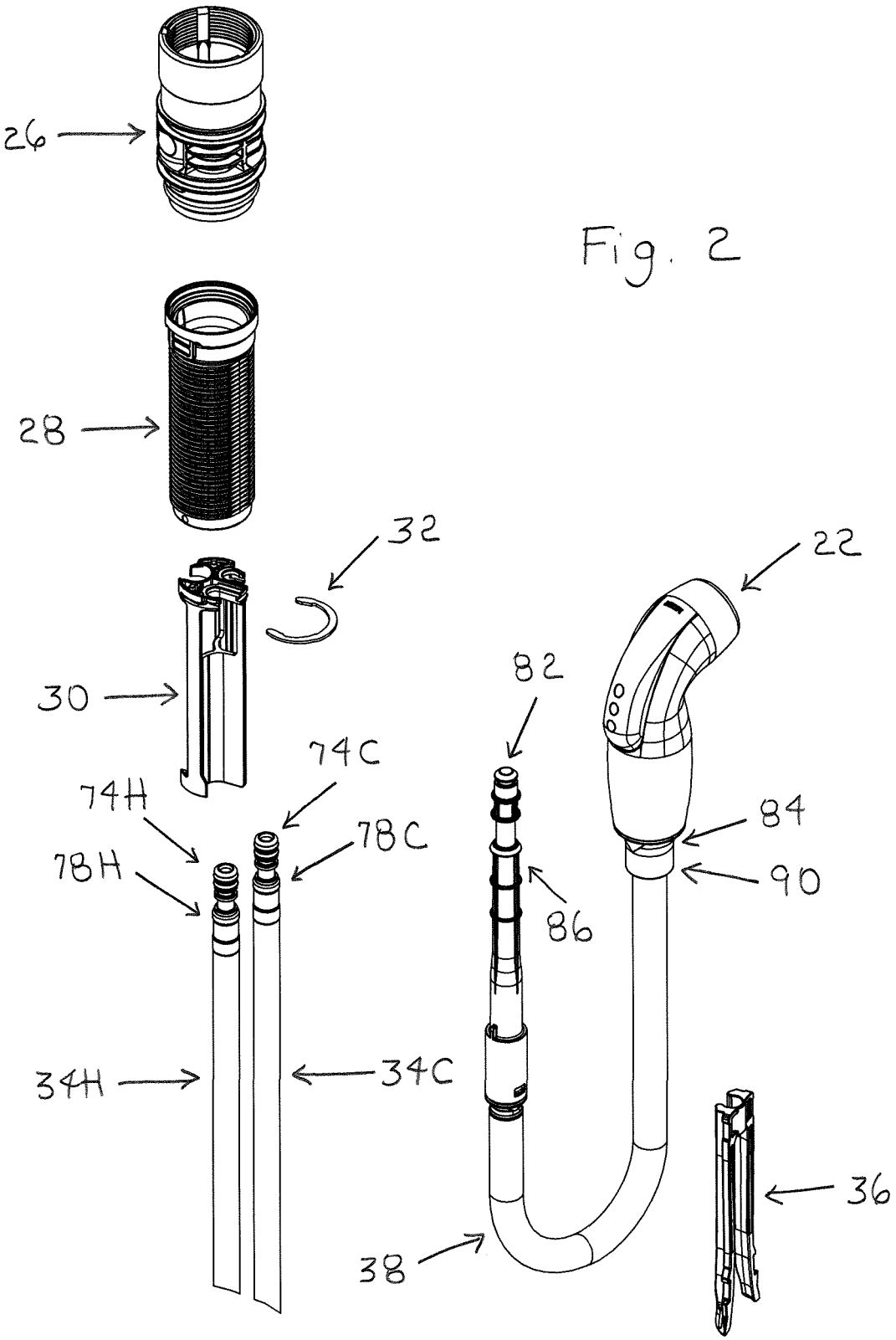
FIG. 2 is an exploded perspective view of components of the faucet of FIG. 1, including a side spray, a valve body, a mounting shank, a supply retainer, supply hoses, a side spray retainer, and a side spray hose.
Figure 3A:
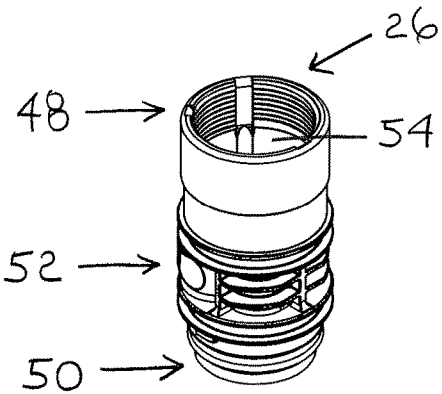
FIGS. 3*a*-3*g* are views of the valve body of FIG. 2
Figure 3C:
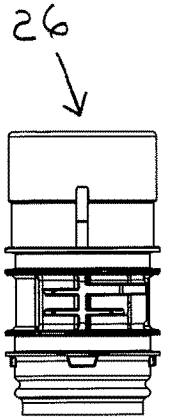
Figure 3E:
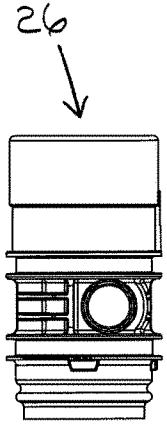
Figure 3F:
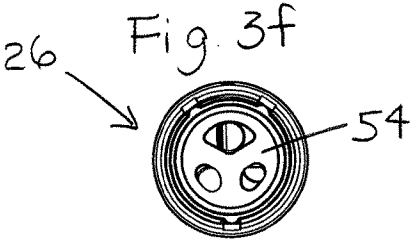
Figure 3B:
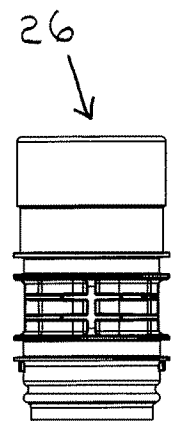
Figure 3G:
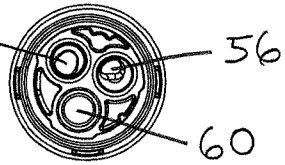
Figure 3D:
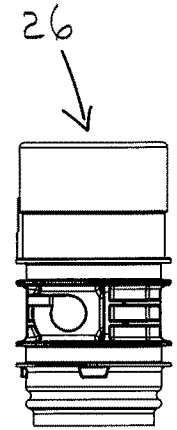
Figure 4A:
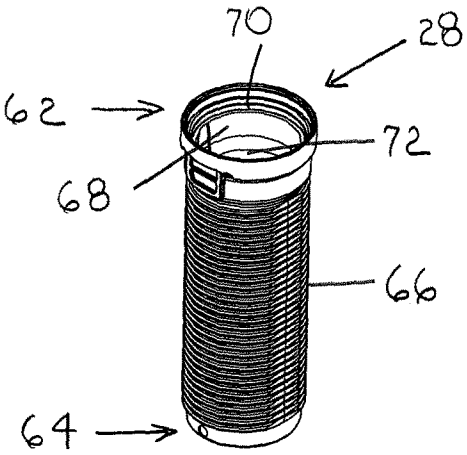
FIGS. 4*a*-4*g* are views of the mounting shank of FIG. 2
Figure 4C:
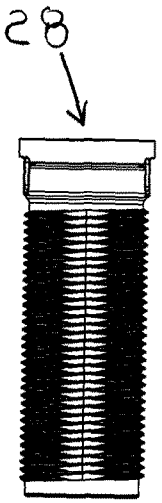
Figure 4E:
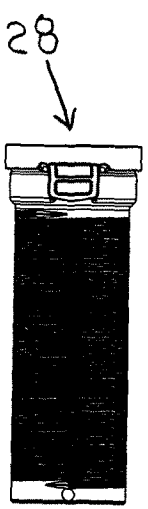
Figure 4F:
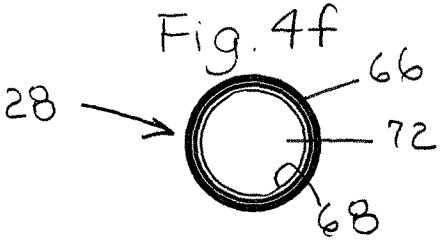
Figure 4B:
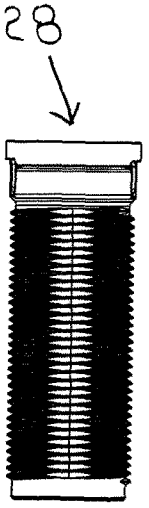
Figure 4G:
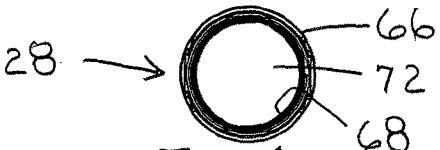
Figure 4D:
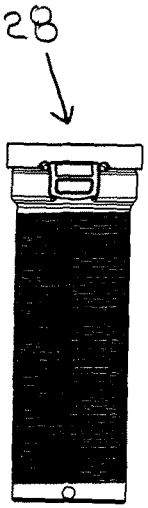
Figure 5A:
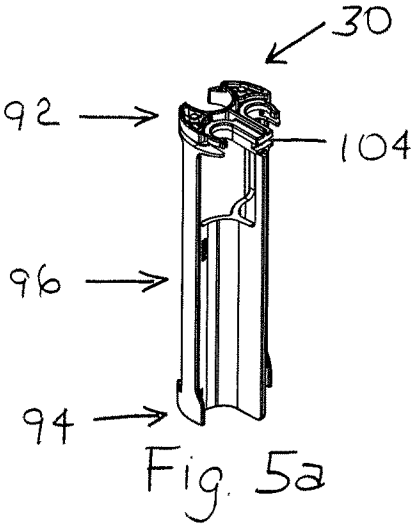
FIGS. 5*a*-5*g* are views of the supply retainer of FIG. 2
Figure 5C:
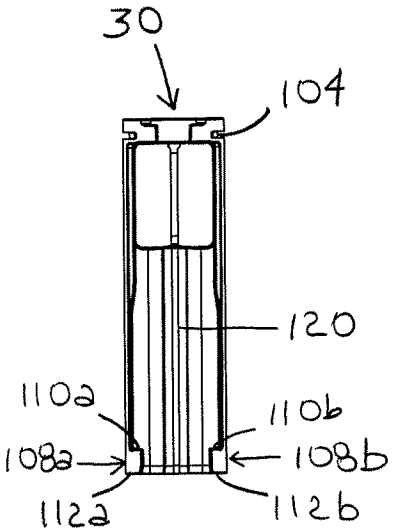
Figure 5E:
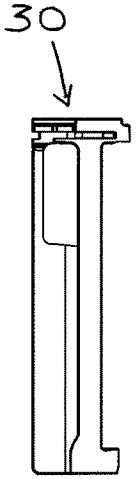
Figure 5B:
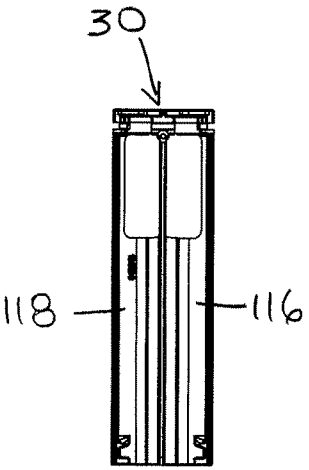
Figure 5D:
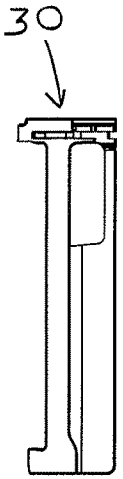
Figure 5F:
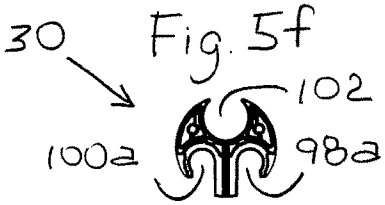
Figure 5G:
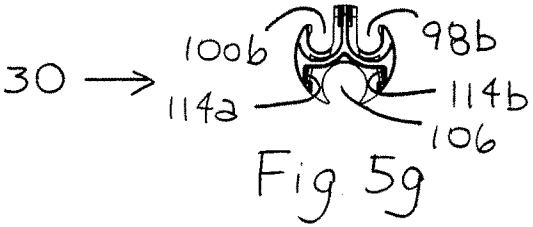
Figure 6A:
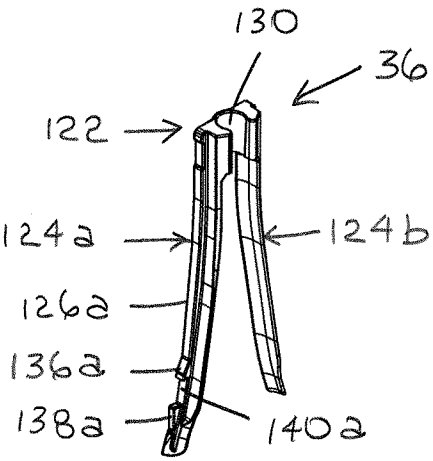
FIGS. 6*a*-6*g* are views of the side spray retainer of FIG. 2
Figure 6C:
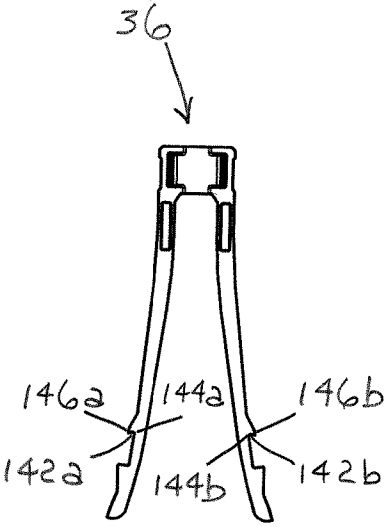
Figure 6E:
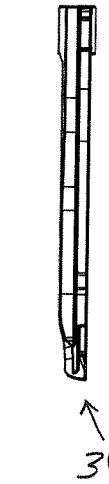
Figure 6F:
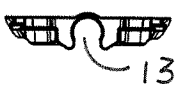
Figure 6B:
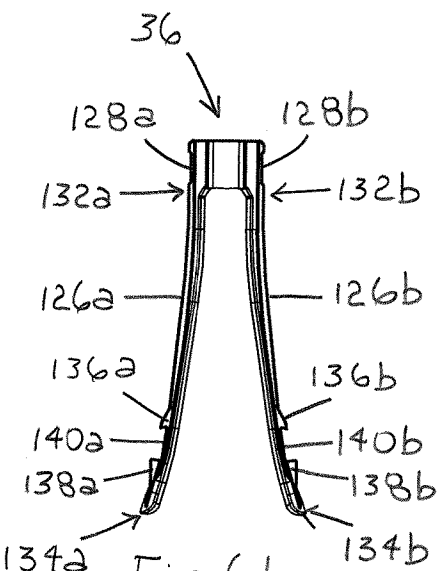
Figure 6D:
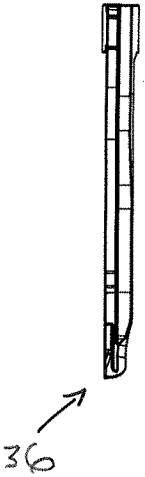
Figure 6G:
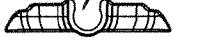
Figure 7B:
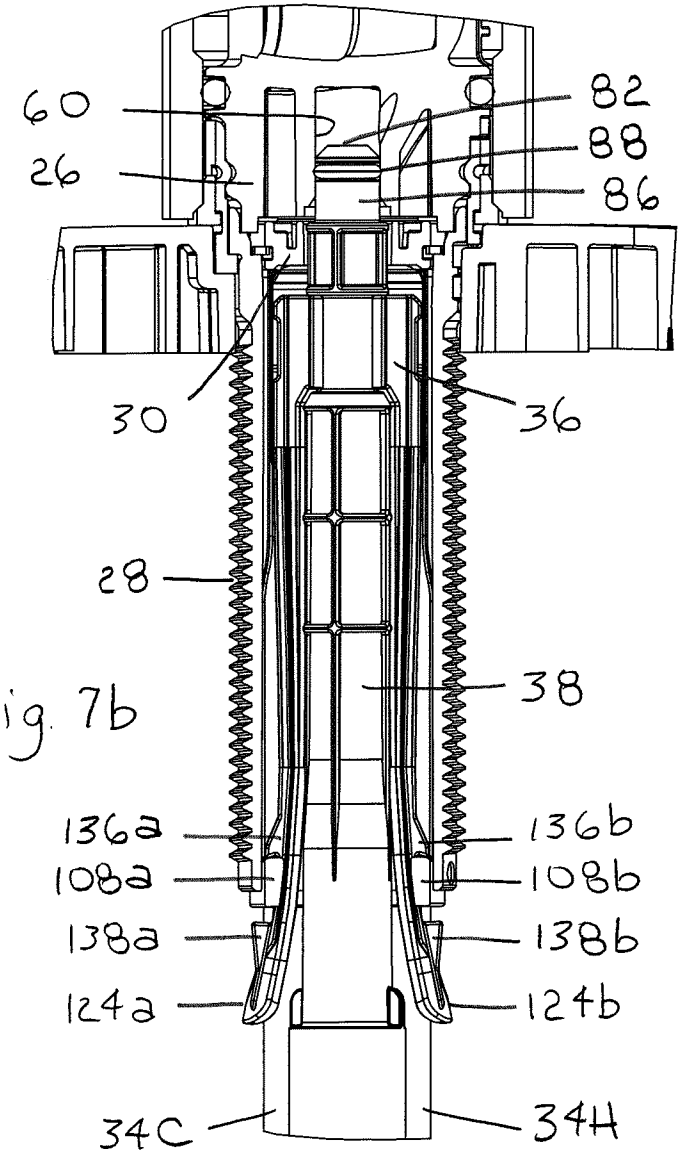
FIGS. 7*a*-7*d* are cross-sectional views of the assembled and installed valve body, mounting shank, supply retainer, supply hoses, side spray retainer, and side spray hose of FIG. 2
Figure 7A:
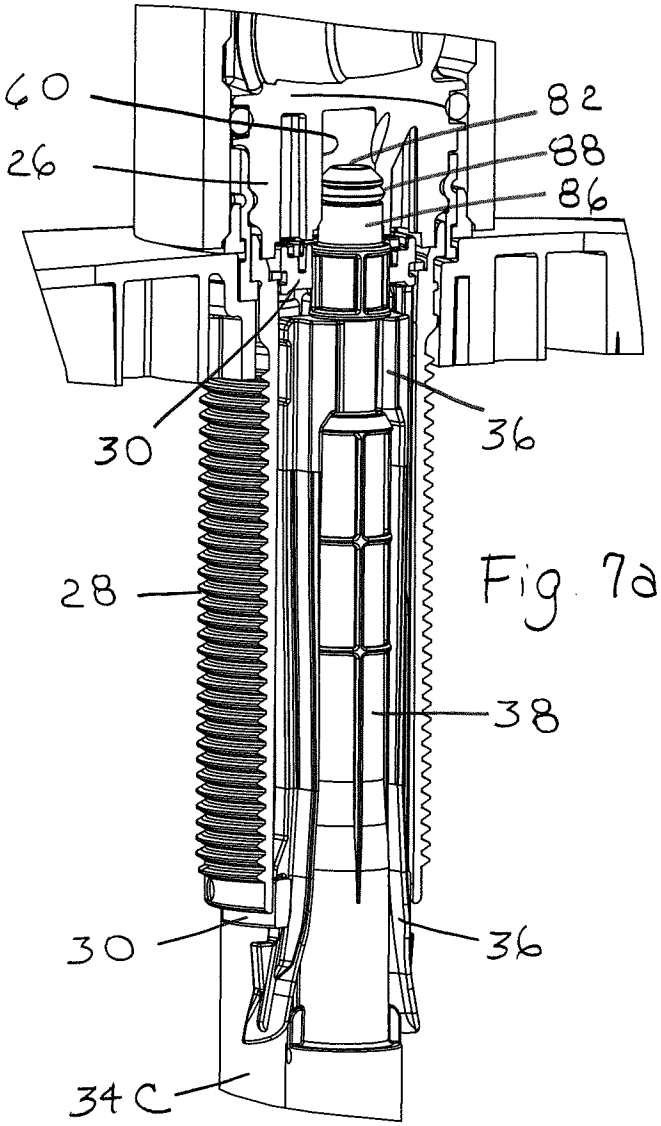
Figure 7C:
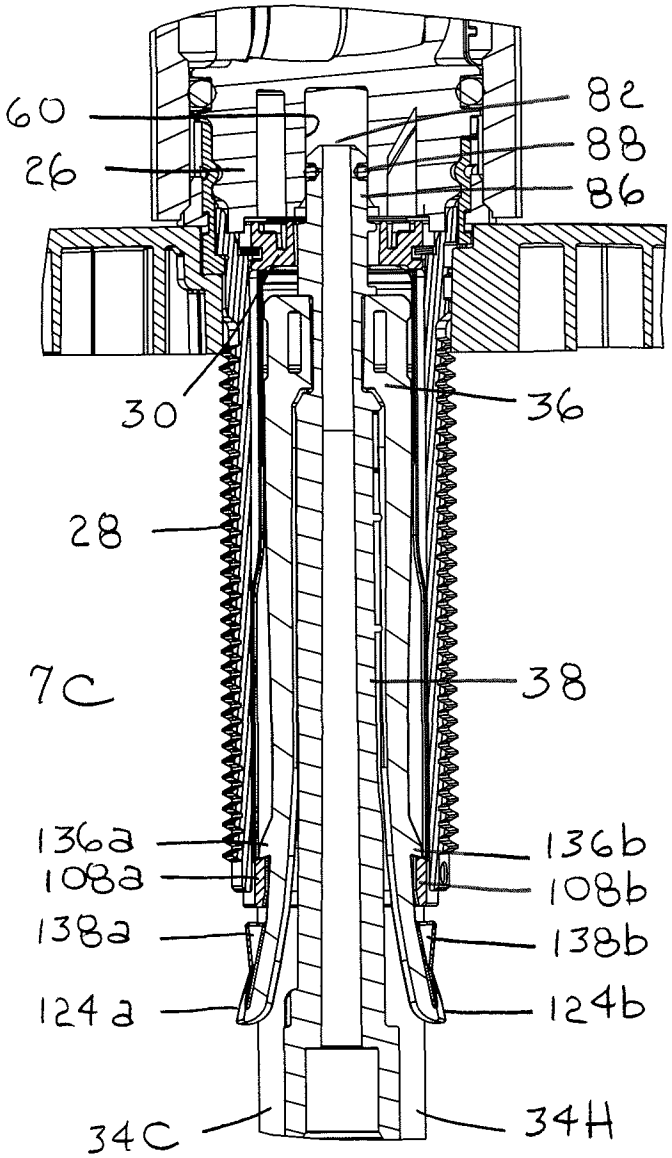
Figure 7D:
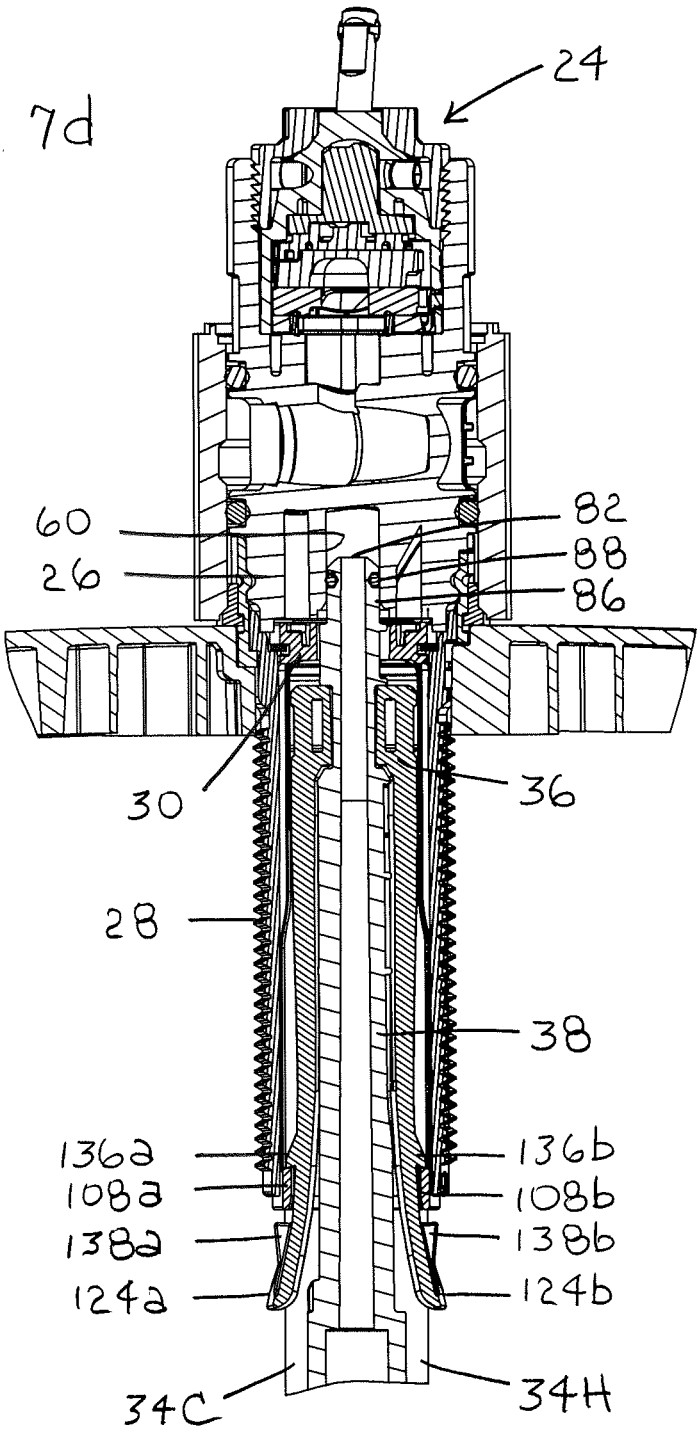

The cold water supply hose 34C and the hot water supply hose 34H supply cold and hot water, respectively, to the faucet 10. Exemplary embodiments of the cold water supply hose 34C and the hot water supply hose 34H are shown in FIGS. 1 and 2. The cold water supply hose 34C includes a first end 74C and a second end 76C. In the illustrated embodiment, the first end 74C includes a first cold water supply hose connector 78C. The first cold water supply hose connector 78C includes a first cold water supply hose sealing member, such as an O-ring. In the illustrated embodiment, the second end 76C includes a second cold water supply hose connector 80C. The second cold water supply hose connector 80C includes a second cold water supply hose sealing member, such as an O-ring. The hot water supply hose 34H includes a first end 74H and a second end 76H. In the illustrated embodiment, the first end 74H includes a first hot water supply hose connector 78H. The first hot water supply hose connector 78H includes a first hot water supply hose sealing member, such as an O-ring. In the illustrated embodiment, the second end 76H includes a second hot water supply hose connector 80H. The second hot water supply hose connector 80H includes a second hot water supply hose sealing member, such as an O-ring.

The side spray hose 38 enables the side spray 20 to be pulled away from and returned to an opening in a countertop in which the faucet 10 is mounted. An exemplary embodiment of the side spray hose 38 is shown in FIGS. 1 and 2. The side spray hose 38 includes a first end 82 and a second end 84. In the illustrated embodiment, the first end 82 includes a first side spray hose connector 86. The first side spray hose connector 86 includes a first side spray hose sealing member 88, such as an O-ring. In the illustrated embodiment, the second end 84 includes a second side spray hose connector 90. The second side spray hose connector 90 includes a second side spray hose sealing member, such as an O-ring.

An exemplary embodiment of the supply retainer 30 is shown in FIGS. 5*a*-5*g*. The supply retainer 30 includes a top or first end section 92, a bottom or second end section 94, and an intermediate section 96.

In the illustrated embodiment, the first end section 92 of the supply retainer 30 includes a first cold water supply hose opening 98*a*, a first hot water supply hose opening 100*a*, a side spray hose opening 102, and a groove 104. In the illustrated embodiment, the first cold water supply hose opening 98*a* is operable to receive the first cold water supply hose connector 78C of the first end 74C of the cold water supply hose 34C. In the illustrated embodiment, the first hot water supply hose opening 100*a* is operable to receive the first hot water supply hose connector 78H of the first end 74H of the hot water supply hose 34H. In the illustrated embodiment, the side spray hose opening 102 is operable to receive the first side spray hose connector 86 of the first end 82 of the side spray hose 38. In the illustrated embodiment, the groove 104 extends in a circumferential direction around at least a portion of the first end section 92 of the supply retainer 30.

In the illustrated embodiment, the second end section 94 of the supply retainer 30 includes a second cold water supply hose opening 98*b*, a second hot water supply hose opening 100*b*, and a side spray retainer opening 106. In the illustrated embodiment, the second cold water supply hose opening 98*b* is operable to receive the cold water supply hose 34C. In the illustrated embodiment, the second hot water supply hose opening 100*b* is operable to receive the hot water supply hose 34H. In the illustrated embodiment, the side spray retainer opening 106 is operable to receive the side spray retainer 36. Additionally, in an exemplary embodiment, the second end section 94 of the supply retainer 30 includes at least one supply retainer tab 108. In an exemplary embodiment, the second end section 94 of the supply retainer 30 includes a plurality of supply retainer tabs 108. In the illustrated embodiment, the second end section 94 of the supply retainer 30 includes a first supply retainer tab 108*a* and a second supply retainer tab 108*b*. In the illustrated embodiment, the first supply retainer tab 108*a* includes a first inner edge 110*a*, a first outer edge 112*a*, and a first groove 114*a*. In the illustrated embodiment, the second supply retainer tab 108*b* includes a second inner edge 110*b*, a second outer edge 112*b*, and a second groove 114*b*.

In the illustrated embodiment, the intermediate section 96 of the supply retainer 30 includes a cold water supply hose channel 116, a hot water supply hose channel 118, and a side spray retainer channel 120. In the illustrated embodiment, the cold water supply hose channel 116 is operable to receive the cold water supply hose 34C. In the illustrated embodiment, the hot water supply hose channel 118 is operable to receive the hot water supply hose 34H. In the illustrated embodiment, the side spray retainer channel 120 is operable to receive the side spray retainer 36.

An exemplary embodiment of the retaining ring 32 is shown in FIG. 2. In the illustrated embodiment, the retaining ring 32 is a generally C-shaped ring. In the illustrated embodiment, the retaining ring 32 is operable to be received in the groove 104 in the first end section 92 of the supply retainer 30.

An exemplary embodiment of the side spray retainer 36 is shown in FIGS. 6*a*-6*g*. In the illustrated embodiment, the side spray retainer includes a top or base section 122. In an exemplary embodiment, the side spray retainer 36 includes at least one leg 124. In an exemplary embodiment, the side spray retainer 36 includes a plurality of legs 124. In the illustrated embodiment, the side spray retainer 36 includes a first leg 124*a* and a second leg 124*b*. In the illustrated embodiment, the side spray retainer 36 includes a first ridge 126*a* and a second ridge 126*b*. In the illustrated embodiment, the first ridge 126*a* extends along the first leg 124*a* and a first side 128*a* of the base section 122 of the side spray retainer 36. In the illustrated embodiment, the first ridge 126*a* is operable to be received in the first groove 114*a* in the first supply retainer tab 108*a* on the second end section 94 of the supply retainer 30. In the illustrated embodiment, the second ridge 126*b* extends along the second leg 124*b* and a second side 128*b* of the base section 122 of the side spray retainer 36. In the illustrated embodiment, the second ridge 126*b* is operable to be received in the second groove 114*b* in the second supply retainer tab 108*b* on the second end section 94 of the supply retainer 30. Additionally, the first ridge 126*a* and the second ridge 126*b* of the side spray retainer 36 provide structural support for the side spray retainer 36.

In the illustrated embodiment, the base section 122 of the side spray retainer 36 includes a side spray hose opening 130. In the illustrated embodiment, the side spray hose opening 130 is operable to receive the first side spray hose connector 86 of the first end 82 of the side spray hose 38.

In the illustrated embodiment, the first leg 124*a* of the side spray retainer 36 includes a first connected end 132*a* and a first free end 134*a*. In the illustrated embodiment, the first connected end 132*a* of the first leg 124*a* of the side spray retainer 36 is connected to the first side 128*a* of the base section 122 of the side spray retainer 36. In the illustrated embodiment, the second leg 124*b* of the side spray retainer 36 includes a second connected end 132*b* and a second free end 134*b*. In the illustrated embodiment, the second connected end 132*b* of the second leg 124*b* of the side spray retainer 36 is connected to the second side 128*b* of the base section 122 of the side spray retainer 36. In an exemplary embodiment, the first leg 124*a* and the second leg 124*b* of the side spray retainer 36 are integrally formed with the base section 122 of the side spray retainer 36.

In the illustrated embodiment, the first free end 134*a* of the first leg 124*a* of the side spray retainer 36 includes a first inner side spray retainer tab 136*a* and a first outer side spray retainer tab 138*a* forming a first side spray retainer notch 140*a* therebetween. In the illustrated embodiment, the first inner side spray retainer tab 136*a* includes a first engagement edge 142*a* that slopes downwardly from a first proximal side 144*a* to a first distal side 146*a*. In the illustrated embodiment, the first supply retainer tab 108*a* on the second end section 94 of the supply retainer 30 is operable to be received in the first side spray retainer notch 140*a* in the first leg 124*a* of the side spray retainer 36. In the illustrated embodiment, the first inner side spray retainer tab 136*a* is operable to engage the first inner edge 110*a* of the first supply retainer tab 108*a* on the second end section 94 of the supply retainer 30. In the illustrated embodiment, due to the downward slope of the first engagement edge 142*a* of the first inner side spray retainer tab 136*a*, the engagement between the first inner side spray retainer tab 136*a* and the first supply retainer tab 108*a* is pressure energized. In the illustrated embodiment, the first outer side spray retainer tab 138*a* is operable to engage the first outer edge 112*a* of the first supply retainer tab 108*a* on the second end section 94 of the supply retainer 30.

In the illustrated embodiment, the second free end 134*b* of the second leg 124*b* of the side spray retainer 36 includes a second inner side spray retainer tab 136*b* and a second outer side spray retainer tab 138*b* forming a second side spray retainer notch 140*b* therebetween. In the illustrated embodiment, the second inner side spray retainer tab 136*b* includes a second engagement edge 142*b* that slopes downwardly from a second proximal side 144*b* to a second distal side 146*b*. In the illustrated embodiment, the second supply retainer tab 108*b* on the second end section 94 of the supply retainer 30 is operable to be received in the second side spray retainer notch 140*b* in the second leg 124*b* of the side spray retainer 36. In the illustrated embodiment, the second inner side spray retainer tab 136*b* is operable to engage the second inner edge 110*b* of the second supply retainer tab 108*b* on the second end section 94 of the supply retainer 30. In the illustrated embodiment, due to the downward slope of the second engagement edge 142*b* of the second inner side spray retainer tab 136*b*, the engagement between the second inner side spray retainer tab 136*b* and the second supply retainer tab 108*b* is pressure energized. In the illustrated embodiment, the second outer side spray retainer tab 138*b* is operable to engage the second outer edge 112*b* of the second supply retainer tab 108*b* on the second end section 94 of the supply retainer 30.

In an exemplary embodiment, the first leg 124*a* and the second leg 124*b* of the side spray retainer 36 are flexible. As a result, the first leg 124*a* and the second leg 124*b* can be pressed inwardly toward each other to assist with inserting the side spray retainer 36 into the side spray retainer channel 120 in the supply retainer 30.

In an exemplary embodiment, the supply retainer 30 is separately formed from the side spray retainer 36. In an exemplary embodiment, the supply retainer 30 is integrally formed. In an exemplary embodiment, the supply retainer 30 is formed from an injection molded thermoplastic. In an exemplary embodiment, the side spray retainer 36 is integrally formed. In an exemplary embodiment, the side spray retainer 36 is formed from an injection molded thermoplastic.

The assembly and installation of the illustrated supply and valve components of the faucet 10 will now be described. The first cold water supply hose connector 78C of the cold water supply hose 34C and the first hot water supply hose connector 78H of the hot water supply hose 34H are inserted into the first cold water supply hose opening 98*a* and the first hot water supply hose opening 100*a*, respectively, in the first end section 92 of the supply retainer 30. In the illustrated embodiment, the first cold and hot water supply hose connectors 78C, 78H are snap fit in the first cold and hot water supply hose openings 98*a*, 100*a*. The cold water supply hose 34C and the hot water supply hose 34H should extend in the cold water supply hose channel 116 and the hot water supply hose channel 118, respectively, in the intermediate section 96 of the supply retainer 30. The retaining ring 32 is inserted into the groove 104 in the first end section 92 of the supply retainer 30.

The second end 76C of the cold water supply hose 34C and the second end 76H of the hot water supply hose 34H are inserted into the first end 62 of the mounting shank 28 and through the mounting shank 28. The second end section 94 of the supply retainer 30 (with the cold water supply hose 34C and the hot water supply hose 34H extending therein) is inserted into the first end 62 of the mounting shank 28 until the retaining ring 32 in the groove 104 in the first end section 92 of the supply retainer 30 rests on the mounting ledge 70 on the inner surface 68 at or near the first end 62 of the mounting shank 28. The first cold water supply hose connector 78C and the first hot water supply hose connector 78H should extend out of the first end 62 of the mounting shank 28. The cold water supply hose 34C and the hot water supply hose 34H should extend out of the second end 64 of the mounting shank 28.

The second end section 50 of the valve body 26 is inserted into the first end 62 of the mounting shank 28 until the first cold water supply hose connector 78C and the first hot water supply hose connector 78H are received in the cold water inlet 56 and the hot water inlet 58, respectively, in the second end section 50 of the valve body 26. The cold water supply hose 34C and the hot water supply hose 34H are now fluidically connected to the valve body 26. The second end section 50 of the valve body 26 is secured in the first end 62 of the mounting shank 28 using any known connection mechanism, such as crimping. The supply retainer 30 is now secured in the mounting shank 28.

The assembly and installation of the illustrated side spray components of the faucet 10 will now be described. The first side spray hose connector 86 is inserted into the side spray hose opening 130 in the base section 122 of the side spray retainer 36. In the illustrated embodiment, the first side spray hose connector 86 is snap fit in the side spray hose opening 130. The side spray hose 38 should extend between the first leg 124*a* and the second leg 124*b* of the side spray retainer 36.

The base section 122 of the side spray retainer 36 (with the side spray hose 38 connected thereto) is inserted through the side spray retainer opening 106 in the second end section 94 of the supply retainer 30 and into the side spray retainer channel 120 in the intermediate section 96 of the supply retainer 30 (which is received in the mounting shank 28). In an exemplary embodiment, a shape of at least a portion of the side spray retainer 36 corresponds to a shape of at least a portion of the side spray retainer channel 120 in the supply retainer 30 to ensure that the side spray retainer 36 is properly oriented when inserted into the supply retainer 30 in the mounting shank 28. In the illustrated embodiment, the first and second ridges 126*a*, 126*b* on the side spray retainer 36 are operable to be received in the first and second grooves 114*a*, 114*b* in the first and second supply retainer tabs 108*a*, 108*b* of the second end section 94 of the supply retainer 30 to ensure that the side spray retainer 36 is properly oriented when inserted into the supply retainer 30 in the mounting shank 28. The first leg 124*a* and the second leg 124*b* of the side spray retainer 36 can be pressed inwardly toward each other to assist with inserting the side spray retainer 36 into the supply retainer 30 in the mounting shank 28.

Once the side spray retainer 36 is inserted a sufficient distance into the supply retainer 30 in the mounting shank 28, the first side spray hose connector 86 of the side spray hose 38 extends through the side spray hose opening 102 in the first end section 92 of the supply retainer 30 and is received in the side spray outlet 60 in the second end section 50 of the valve body 26. The first side spray hose connector 86 of the side spray hose 38 is fluidically sealed in the side spray outlet 60 in the second end section 50 of the valve body 26. Thus, the side spray hose 38 is now fluidically connected to the valve body 26 at or near the first end 62 of the mounting shank 28.

Additionally, once the side spray retainer 36 is inserted a sufficient distance into the supply retainer 30 in the mounting shank 28, the first and second supply retainer tabs 108*a*, 108*b* on the second end section 94 of the supply retainer 30 move past the first and second inner side spray retainer tabs 136*a*, 136*b* on the first and second legs 124*a*, 124*b* of the supply retainer 30 and are received in the first and second side spray retainer notches 140*a*, 140*b* formed between the first and second inner side spray retainer tabs 136*a*, 136*b* and the first and second outer side spray retainer tabs 138*a*, 138*b* on the first and second legs 124*a*, 124*b* of the side spray retainer 36, respectively. In the illustrated embodiment, as the first and second supply retainer tabs 108*a*, 108*b* move past the first and second inner side spray retainer tabs 136*a*, 136*b*, the first and second legs 124*a*, 124*b* move outwardly away from each other and the first and second supply retainer tabs 108*a*, 108*b* are snap fit in the first and second side spray retainer notches 140*a*, 140*b*. The first and second inner side spray retainer tabs 136*a*, 136*b* on the first and second legs 124*a*, 124*b* of the side spray retainer 36 engage the first and second inner edges 110*a*, 110*b* of the first and second supply retainer tabs 108*a*, 108*b* and prevent the side spray retainer 36 from coming out of the supply retainer 30 (and thus, the mounting shank 28). The first and second outer side spray retainer tabs 138*a*, 138*b* on the first and second legs 124*a*, 124*b* of the side spray retainer 36 can engage the first and second outer edges 112*a*, 112*b* of the first and second supply retainer tabs 108*a*, 108*b* and prevent the side spray retainer 36 from being inserted too far into the supply retainer 30 (and thus, the mounting shank 28). The side spray retainer 36 is secured in the supply retainer 30 in the mounting shank 28. Thus, the side spray hose 38 (which is connected to the side spray retainer 36) is now mechanically connected to the valve body 26 at or near the second end 64 of the mounting shank 28 (in which the supply retainer 30 is secured).

The uninstallation and disassembly of the illustrated side spray components of the faucet 10 will now be described. The first leg 124*a* and the second leg 124*b* of the side spray retainer 36 are pressed inwardly toward each other until the first and second supply retainer tabs 108*a*, 108*b* are no longer received in the first and second side spray retainer notches 140*a*, 140*b* formed between the first and second inner side spray retainer tabs 136*a*, 136*b* and the first and second outer side spray retainer tabs 138*a*, 138*b* on the first and second legs 124*a*, 124*b* of the side spray retainer 36. The side spray retainer 36 can now be removed from the supply retainer 30 and the mounting shank 28. Once the side spray retainer 36 has been removed from the supply retainer 30 and the mounting shank 28, the first side spray hose connector 86 of the side spray hose 38 can be removed from the side spray hose opening 130 in the base section 122 of the side spray retainer 36.

While the assembly, installation, uninstallation, and disassembly steps having been described above in a particular order, one of ordinary skill in the art will appreciate that these steps do not need to be performed in this order.

One of ordinary skill in the art will now appreciate that the present invention provides a faucet with a hose connection that is easier to assemble, install, uninstall, and disassemble. Although the present invention has been shown and described with reference to a particular embodiment, equivalent alterations and modifications will occur to those skill in the art upon reading and understanding this specification. The present invention includes all such equivalent alterations and modifications and is limited only by the scope of the following claims in light of their full scope of equivalents.

What is claimed is:

1. A hose connection for a faucet, comprising:

a hose, the hose including a first end and a second end, the first end of the hose including a first hose connector, the second end of the hose including a second hose connector;

a valve body, the valve body including a first end section and a second end section, the first end section of the valve body including a first opening, the first opening in the first end section of the valve body being operable to receive a cartridge assembly, the second end section of the valve body including a second opening, the second opening in the second end section of the valve body being operable to receive the first hose connector;

a mounting shank, the mounting shank including a first end, a second end, and an opening extending through the mounting shank from the first end to the second end, the first end of the mounting shank being operable to be secured to the second end section of the valve body;

a first hose retainer, the first hose retainer including a base section, the base section of the first hose retainer including a first hose opening, the first hose opening in the base section of the first hose retainer being operable to receive at least a portion of the hose; and a second hose retainer, the second hose retainer including a first end section, a second end section, and an intermediate section, the first end section of the second hose retainer including a second hose opening, the second hose opening in the first end section of the second hose retainer being operable to receive at least a portion of the hose, the second end section of the second hose retainer including a first hose retainer opening, the first hose retainer opening in the second end section of the second hose retainer being operable to receive at least a portion of the first hose retainer, the intermediate section of the second hose retainer including a first hose retainer channel, the first hose retainer channel in the intermediate section of the second hose retainer being operable to receive at least a portion of the first hose retainer;

wherein the first hose connector of the hose is fluidically sealed in the second opening in the second end section of the valve body thereby fluidically connecting the hose to the valve body approximately at the first end of the mounting shank; and wherein at least a portion of the first hose retainer engages at least a portion of the second hose retainer thereby mechanically connecting the hose to the valve body approximately at the second end of the mounting shank.

2. The hose connection for a faucet of claim 1, wherein:

the first hose retainer further includes a first leg, the first leg of the first hose retainer includes a first connected end and a first free end, the first free end of the first leg of the first hose retainer includes a first inner retainer tab;

the second end section of the second hose retainer includes a first retainer tab; and the first inner retainer tab on the first free end of the first leg of the first hose retainer is operable to engage the first retainer tab on the second end section of the second hose retainer.

3. The hose connection for a faucet of claim 2, wherein:

the first leg of the first hose retainer includes a first ridge;

the first retainer tab on the second end section of the second hose retainer includes a first groove; and the first ridge on the first leg of the first hose retainer is operable to be received in the first groove in the first retainer tab on the second end section of the second hose retainer to ensure that the first hose retainer is properly oriented when inserted into the second hose retainer.

4. The hose connection for a faucet of claim 2, wherein:

the first free end of the first leg of the first hose retainer includes a first outer retainer tab; and the first outer retainer tab on the first free end of the first leg of the first hose retainer is operable to engage the first retainer tab on the second end section of the second hose retainer.

5. The hose connection for a faucet of claim 3, wherein:

the first hose retainer includes a second leg, the second leg of the first hose retainer includes a second connected end and a second free end, the second free end of the second leg of the first hose retainer includes a second inner retainer tab;

the second end section of the second hose retainer includes a second retainer tab; and the second inner retainer tab on the second free end of the second leg of the first hose retainer is operable to engage the second retainer tab on the second end section of the second hose retainer.

6. The hose connection for a faucet of claim 5, wherein:

the second leg of the first hose retainer includes a second ridge;

the second retainer tab on the second end section of the second hose retainer includes a second groove; and the second ridge on the second leg of the first hose retainer is operable to be received in the second groove in the second retainer tab on the second end section of the second hose retainer to ensure that the first hose retainer is properly oriented when inserted into the second hose retainer.

7. The hose connection for a faucet of claim 5, wherein:

the hose is operable to extend between the first leg and the second leg of the first hose retainer;

the first leg and the second leg of the first hose retainer are flexible; and the first leg and the second leg of the first hose retainer are operable to be pressed toward each other to assist in inserting the first hose retainer into the first hose retainer channel in the intermediate section of the second hose retainer.

8. A hose connection for a faucet, comprising:

a supply hose, the supply hose including a first end and a second end, the first end of the supply hose including a first supply hose connector, the second end of the supply hose including a second supply hose connector;

a spray hose, the spray hose including a first end and a second end, the first end of the spray hose including a first spray hose connector, the second end of the spray hose including a second spray hose connector;

a spray retainer, the spray retainer including a base section and a first leg, the base section of the spray retainer including a spray hose opening, the spray hose opening in the base section of the spray retainer being operable to receive at least a portion of the spray hose, the first leg of the spray retainer including a first connected end and a first free end; and a supply retainer, the supply retainer including a first end section, a second end section, and an intermediate section, the first end section of the supply retainer including a first supply hose opening and a first spray hose opening, the first supply hose opening in the first end section of the supply retainer being operable to receive at least a portion of the supply hose, the first spray hose opening in the first end section of the supply retainer being operable to receive at least a portion of the spray hose, the second end section of the supply retainer including a second supply hose opening and a spray retainer opening, the second supply hose opening in the second end section of the supply retainer being operable to receive at least a portion of the supply hose, the spray retainer opening in the second end section of the supply retainer being operable to receive at least a portion of the spray retainer, the intermediate section of the supply retainer including a supply hose channel and a spray retainer channel, the supply hose channel in the intermediate section of the supply retainer being operable to receive at least a portion of the supply hose, the spray retainer channel in intermediate section of the supply retainer being operable to receive at least a portion of the spray retainer;

wherein structure on at least one of the base section and the first leg of the spray retainer engages structure on at least one of the second end section and the intermediate section of the supply retainer to mechanically connect the spray retainer to the supply retainer.

9. The hose connection for a faucet of claim 8, wherein:
the first free end of the first leg of the spray retainer includes a first inner spray retainer tab;
the second end section of the supply retainer includes a first supply retainer tab; and
the first inner spray retainer tab on the first free end of the first leg of the spray retainer is operable to engage the first supply retainer tab on the second end section of the supply retainer.

10. The hose connection for a faucet of claim 9, wherein:
the first leg of the spray retainer includes a first ridge;
the first supply retainer tab on the second end section of the supply retainer includes a first groove; and
the first ridge on the first leg of the spray retainer is operable to be received in the first groove in the second end section of the supply retainer to ensure that the spray retainer is properly oriented when inserted into the supply retainer.

11. The hose connection for a faucet of claim 9, wherein:
the first free end of the first leg of the spray retainer includes a first outer spray retainer tab; and
the first outer spray retainer tab on the first free end of the first leg of the spray retainer is operable to engage the first supply retainer tab on the second end section of the supply retainer.

12. The hose connection for a faucet of claim 10, wherein:
the spray retainer includes a second leg, the second leg includes a second connected end and a second free end, the second free end includes a second inner spray retainer tab;
the second end section of the supply retainer includes a second supply retainer tab; and
the second inner spray retainer tab on the second free end of the second leg of the spray retainer is operable to engage the second supply retainer tab on the second end section of the supply retainer.

13. The hose connection for a faucet of claim 12, wherein:
the second leg of the spray retainer includes a second ridge;
the second supply retainer tab on the second end section of the supply retainer includes a second groove; and
the second ridge on the second leg of the spray retainer is operable to be received in the second groove in the second supply retainer tab on the second end section of the supply retainer to ensure that the spray retainer is properly oriented when inserted into the supply retainer.

14. The hose connection for a faucet of claim 12, wherein:
the spray hose is operable to extend between the first leg and the second leg of the spray retainer;
the first leg and the second leg of the spray retainer are flexible; and
the first leg and the second leg are operable to be pressed toward each other to assist in inserting the spray retainer into the spray retainer channel in the intermediate section of the supply retainer.

15. A hose connection for a faucet, comprising:
a supply hose, the supply hose including a first end and a second end, the first end of the supply hose including a first supply hose connector, the second end of the supply hose including a second supply hose connector;
a spray hose, the spray hose including a first end and a second end, the first end of the spray hose including a first spray hose connector, the second end of the spray hose including a second spray hose connector;
a spray retainer, the spray retainer including a base section and a first leg, the base section of the spray retainer including a spray hose opening, the first leg of the spray retainer including a first connected end and a first free end, the first free end of the first leg of the spray retainer including a first inner spray retainer tab; and
a supply retainer, the supply retainer including a first end section, a second end section, and an intermediate section, the first end section of the supply retainer including a first supply hose opening and a spray hose opening, the first supply hose opening in the first end section of the supply retainer being operable to receive at least a portion of the supply hose, the spray hose opening in the first end section of the supply retainer being operable to receive at least a portion of the spray hose, the second end section of the supply retainer including a second supply hose opening, a spray retainer opening, and a first supply retainer tab, the second supply hose opening in the second end section of the supply retainer being operable to receive at least a portion of the supply hose, the spray retainer opening in the second end section of the supply retainer being operable to receive at least a portion of the spray retainer, the intermediate section of the supply retainer including a supply hose channel and a spray retainer channel, the supply hose channel in the intermediate section of the supply retainer being operable to receive at least a portion of the supply hose, the spray retainer channel in the intermediate section of the supply retainer being operable to receive at least a portion of the spray retainer;
wherein the first inner spray retainer tab on the first free end of the first leg of the spray retainer engages the first supply retainer tab on the second end section of the supply retainer to mechanically connect the spray retainer to the supply retainer.

16. The hose connection for a faucet of claim 15, wherein:
the first leg of the spray retainer includes a first ridge;
the first supply retainer tab on the second end section of the supply retainer includes a first groove; and
the first ridge on the first leg of the spray retainer is operable to be received in the first groove in the first supply retainer tab on the second end section of the supply retainer to ensure that the spray retainer is properly oriented when inserted into the supply retainer.

17. The hose connection for a faucet of claim 15, wherein:
the free end of the first leg of the spray retainer includes a first outer spray retainer tab; and
the first outer spray retainer tab on the first free end of the first leg of the spray retainer is operable to engage the first supply retainer tab on the second end section of the supply retainer.

18. The hose connection for a faucet of claim 16, wherein:
the spray retainer includes a second leg, the second leg of the spray retainer includes a second connected end and a second free end, the second free end of the second leg of the spray retainer includes a second inner spray retainer tab;
the second end section of the supply retainer includes a second supply retainer tab; and
the second inner spray retainer tab on the second free end of the second leg of the spray retainer is operable to engage the second supply retainer tab on the second end section of the supply retainer.

19. The hose connection for a faucet of claim 18, wherein:
the second leg of the spray retainer includes a second ridge;

the second supply retainer tab on the second end section of the supply retainer includes a second groove; and the second ridge on the second leg of the spray retainer is operable to be received in the second groove in the second supply retainer tab on the second end section of the second supply retainer tab to ensure that the spray retainer is properly oriented when inserted into the supply retainer.

20. The hose connection for a faucet of claim 18, wherein:

the spray hose is operable to extend between the first leg and the second leg of the spray retainer;

the first leg and the second leg of the spray retainer are flexible; and the first leg and the second leg of the spray retainer are operable to be pressed toward each other to assist in inserting the spray retainer into the spray retainer channel in the intermediate section of the supply retainer.

* * * * *